US008968640B2

(12) United States Patent
Dirlenbach et al.

(10) Patent No.: US 8,968,640 B2
(45) Date of Patent: Mar. 3, 2015

(54) CLAY GUN MACHINE CANNON FOR METALLURGICAL FURNACES

(75) Inventors: Oliver Dirlenbach, Olpe (DE); Ralf Taugerbeck, Netphen (DE)

(73) Assignee: TMT Tapping-Measuring-Technology GmbH, Siegen (DE)

( * ) Notice: Subject to any disclaimer, the term of this patent is extended or adjusted under 35 U.S.C. 154(b) by 251 days.

(21) Appl. No.: 13/521,598

(22) PCT Filed: Jan. 12, 2011

(86) PCT No.: PCT/EP2011/050347

§ 371 (c)(1), (2), (4) Date: Jul. 11, 2012

(87) PCT Pub. No.: WO2011/089054

PCT Pub. Date: Jul. 28, 2011

(65) Prior Publication Data

US 2012/0292836 A1 Nov. 22, 2012

(30) Foreign Application Priority Data

Jan. 20, 2010 (DE) ..... 10 2010 001 038

(51) Int. Cl.

| | |
|---|---|
| ***C21B 7/12*** | (2006.01) |
| ***F27D 3/15*** | (2006.01) |
| ***C21C 5/46*** | (2006.01) |
| ***F27B 1/10*** | (2006.01) |
| ***F27B 1/21*** | (2006.01) |
| ***F27B 3/19*** | (2006.01) |

(52) U.S. Cl.

CPC ..... *F27D 3/1536* (2013.01); *C21B 7/125* (2013.01); *C21C 5/4653* (2013.01); *F27B 1/10* (2013.01); *F27B 1/21* (2013.01); *F27B 3/19* (2013.01)

USPC ..... 266/273; 266/272

(58) Field of Classification Search

CPC ..... C21B 7/125

USPC ..... 266/273, 272

See application file for complete search history.

(56) References Cited

U.S. PATENT DOCUMENTS

| | | | | |
|---|---|---|---|---|
| 3,682,456 | A | 8/1972 | Berczynski | |
| 3,984,091 | A | 10/1976 | Schneider | |
| 2012/0292836 | A1 * | 11/2012 | Dirlenbach et al. | 266/273 |

FOREIGN PATENT DOCUMENTS

| | | | |
|---|---|---|---|
| CN | 2918438 | Y | 7/2007 |

(Continued)

OTHER PUBLICATIONS

English Translation of the PCT International Preliminary Report on Patentability, PCT/EP2011/050347, Aug. 16, 2012.

(Continued)

*Primary Examiner* — Scott Kastler

(74) *Attorney, Agent, or Firm* — Quarles & Brady LLP

(57) ABSTRACT

The invention relates to a clay gun machine cannon (10) for metallurgical furnaces having a pressure cylinder (11) for receiving the plugging mass (13) and a compaction ram (14) for pressing the plugging mass (13) out of a mouthpiece (19) of the pressure cylinder pressed to the tapping hole of the furnace, wherein the pressure cylinder (11) has a cylinder liner having a wear sleeve assembly (18) inserted in the cylinder liner which is made of at least one insert sleeve made of a welded plate section.

11 Claims, 1 Drawing Sheet

(56) References Cited

FOREIGN PATENT DOCUMENTS

| | | | |
|---|---|---|---|
| CN | 101104906 | A | 1/2008 |
| DE | 197 55 932 | C1 | 12/1998 |
| EP | 1 312 883 | | 5/2003 |
| EP | 2 264 391 | | 12/2010 |
| JP | S4918087 | U | 2/1974 |
| JP | S58161762 | A | 9/1983 |
| KR | 200 441 704 | | 9/2008 |

OTHER PUBLICATIONS

State Intellectual Property Office of People's Republic of China, First Office Action, Application No. 201180006550.9, Dec. 25, 2013, 9 pages.
International Search Report as mailed on May 13, 2011 for International Application No. PCT/EP2011/050347.
Japan Patent Office, Notice of Reasons for Rejections, Application No. 2012-549306, Aug. 26, 2014, 4 pages.

* cited by examiner

FIG. 1
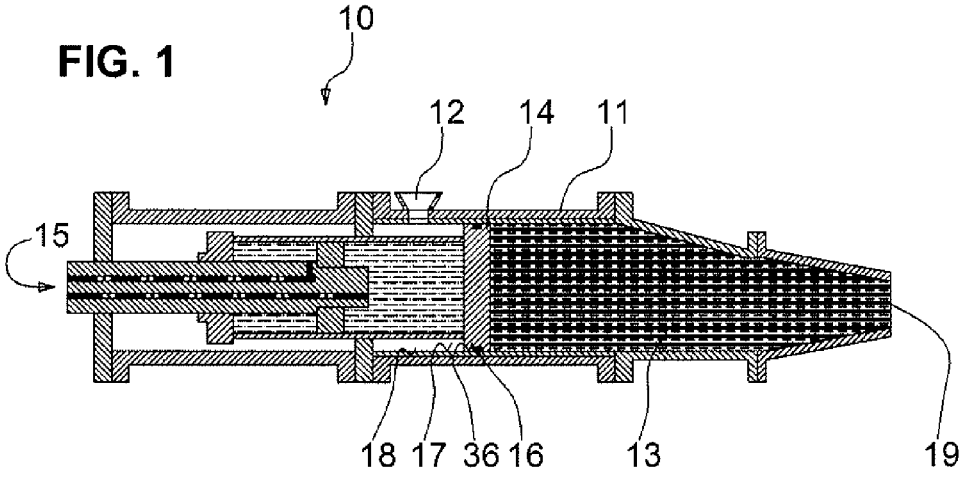
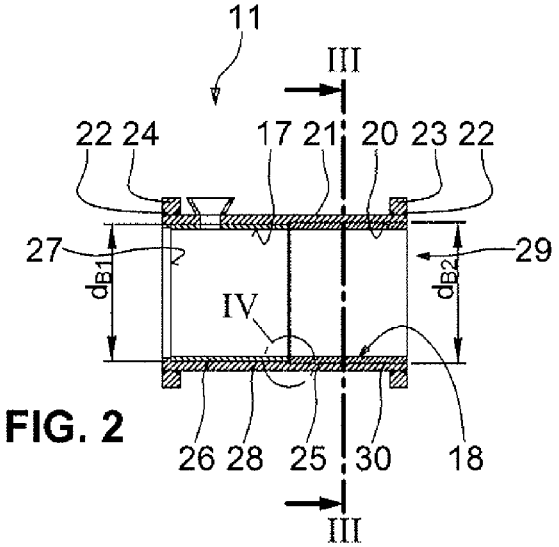
FIG. 2
FIG. 3
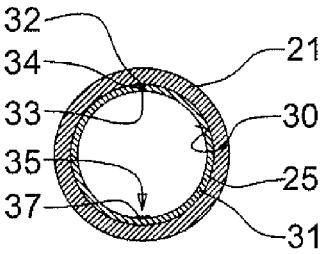
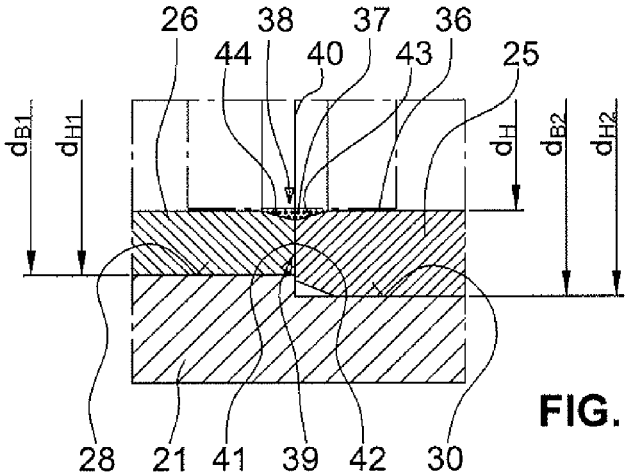
FIG. 4

CLAY GUN MACHINE CANNON FOR METALLURGICAL FURNACES

CROSS-REFERENCE TO RELATED APPLICATIONS

This application represents the national stage entry of PCT International Application No. PCT/EP2011/050347 filed on Jan. 12, 2011 and claims the benefit of German Patent Application No. DE 10 2010 001 038.3 filed Jan. 20, 2010. The contents of both of these applications are hereby incorporated by reference as if set forth in their entirety herein.

The invention relates to a clay gun machine cannon for metallurgical furnaces, comprising a pressure cylinder for receiving the plugging mass and a compaction ram for pressing the plugging mass out of a mouthpiece of the pressure cylinder pressed to the tapping hole of the furnace.

Clay gun machine cannons of the type mentioned initially are used for closing the tapping openings of reduction or melting furnaces, e.g. blast furnaces for obtaining pig iron and low shaft furnaces for melting non-ferrous metals, ferro-alloys etc. During the plugging process the plugging gun is pressed with a large force against the front of the furnace by means of a pivoting apparatus, where the pressing force of the plugging machine is maintained until the plugging mass pressed into the tapping hole opening of the furnace by the plugging gun is hardened.

With the increasing melting capacity of furnaces, the requirements for the tapping technology, particularly with regard to a rapid and reliable opening and closing of the tapping holes have increased over time. In this connection, in particular great efforts have been made with regard to improving the plugging mass with the aim of increasing the lifetime of the plugging mass in the tapping hole by means of a particularly solid and resistant plugging mass and of also being able to use the plugging mass to repair the tapping hole channel as a result of its improved material properties. The result of this development is a particularly wear-resistant plugging mass which however, as a result of its wear resistance or abrasion resistance, causes a correspondingly high wear of the components of the clay gun machine cannon coming in contact with the plugging mass, in particular the pressure cylinder in which plugging mass pressures of 200 daN/cm$^2$ and more are achieved.

The development of these more wear-resistant and therefore more abrasion-intensive plugging masses have therefore been accompanied by corresponding developments in order in particular to improve the wear resistance of the pressure cylinder or the cylinder bore exposed directly to the wear stressing.

Particularly satisfactory results with regard to the desired increase in wear resistance of the cylinder bore of the pressure cylinder have been achieved in the meantime by providing the bore walls of the pressure cylinder with a wear-resistant layer, in particular a hard chromium layer. Since however, regardless of the quality of a measure which increases the wear resistance, this can in any case only lead to a lengthening of the lifetime of the pressure cylinder, after reaching the lifetime the pressure cylinder or the surface of the cylinder bore must be repaired in order to be able to ensure problem-free operation of the clay gun machine cannon.

As shown in practice, the repair or renovation of a surface coating of the bore wall of the pressure cylinder requires considerable process-engineering know-how with the result that such a repair of the pressure cylinder can usually only be carried out at the manufacturer of the pressure cylinder so that this is associated with a corresponding expenditure for the operator of metallurgical furnaces on which the clay gun machine cannon is used.

In order to enable an improvement with regard to the repair costs in pressure cylinders, tests had already been carried out some time ago at the applicants to provide the pressure cylinder with inserted hardened liners. In particular, as a result of the expenditure involved in the manufacture of corresponding liners, the corresponding efforts have however proved unsuitable for practice.

It is now the object of the present invention to provide a clay gun machine cannon having a pressure cylinder with a high wear resistance which can be produced cost-effectively with a repair-friendly design.

In order to solve this object, the clay gun machine cannon according to the invention has the features of claim 1.

In the clay gun machine cannon according to the invention, the pressure cylinder has a cylinder liner having a wear sleeve assembly inserted in the cylinder liner which is made of at least one insert sleeve made of a plate section welded to form a tube.

A wear sleeve assembly configured according to the invention can on the one hand be manufactured cost-effectively as a result of the insert sleeve being manufactured from a plate section. On the other hand, the insert sleeve forms a component independent of the cylinder liner of the pressure cylinder which forms the pressure cylinder in combination with the cylinder liner so that after any wear of the insert sleeve, this component can be removed or exchanged by simply mechanically releasing the bond between the cylinder liner and the insert sleeve. In particular, in the event that the cylinder liner of the pressure cylinder is also designed as a welded structure, an optimised design is obtained with a view to the highest possible component strength accompanied by the lowest possible manufacturing costs.

Unlike in the case of a repair to a pressure cylinder provided with a wear coating on its bore wall, in a repair to a pressure cylinder provided with a wear sleeve assembly according to the invention, only the wear sleeve needs to be exchanged. Other than is the case for application of a wear coating to the bore wall of the pressure cylinder, no particular process-engineering knowhow is required for this purpose, that in particular comprises suitably configured apparatus for carrying this out. On the contrary, a relatively simply configured hydraulic apparatus is usually sufficient for pressing out and subsequently inserting a replacement insert sleeve in order to be able to carry out any maintenance of the pressure cylinder. This can therefore also be accomplished on site at operators of metallurgical furnaces which frequently only have operating resources which are restricted in their scope at their disposal.

If, according to a preferred embodiment of the insert sleeve, this is formed from a plate section formed into a tube with a longitudinal weld seam, the insert sleeve can be inserted in the cylinder liner of the pressure cylinder so that the welded seam is disposed in a radially defined manner in the cylinder liner of the pressure cylinder. This is important insofar as the pressure cylinder which is usually disposed in the plugging insert horizontally above the tapping spout is exposed to the greatest wear due to gravity in its lowest longitudinal section of the cylinder liner. Furthermore, a weld seam region possibly promoting the wear can be specifically disposed outside this wear-intensive longitudinal section of the pressure cylinder.

It proves to be advantageous with regard to a wear-resistant design of the insert sleeve if the plate section is formed from a low-carbon steel hardened by heat treatment since in this case as a result of a relatively low carbon content, a sufficient hardness of the insert sleeve can be achieved with simultaneously good welding properties without alloying components which possibly have a negative influence on the welding properties being required for this purpose.

Particularly good results with regard to the manufacturability of the insert sleeve in the welding process have been achieved by using a plate section made of steel whose C content is less than 0.5 wt. % and whose Cr content is less than 1.5 wt. %.

It has proved particularly advantageous to use a steel plate whose C content is less than 0.25 wt. % and whose Cr content is less than 0.75 wt. %.

A substantial contribution of the insert sleeve to the overall component strength of the pressure cylinder can be achieved if the wall thickness of the insert sleeve is at least 10% of the wall thickness of the cylinder liner. By this means the insert sleeve not only acts advantageously as an exchangeable wear part but also contributes decisively to the component strength of the pressure cylinder in the combined effect with the cylinder liner. Accordingly, compared to a pressure cylinder whose cylinder liner is provided with a coating on its bore wall, reduced wall thicknesses of the cylinder liner are possible so that corresponding material and cost savings are possible.

The effects discussed hereinbefore are particularly marked if the wall thickness of the insert sleeve is between 20% and 40% of the wall thickness of the cylinder liner.

In a particularly preferred embodiment, the wear sleeve assembly is composed of two insert sleeves so that, for example, in the front part of the pressure cylinder facing the mouthpiece of the pressure cylinder, which is subject to particularly high wear, a locally limited or partial exchange of the wear sleeve assembly is possible.

The wear sleeve assembly composed of two or more insert sleeves is configured particularly advantageously if the insert sleeves are inserted in the cylinder liner in such a manner that they form a connection joint with mutually opposite front faces having a groove cross-section formed by bevels on the inner edges of the front faces. On the one hand, this prevents an edge projecting abruptly from the contact face of the pressure cylinder with the piston from being formed in the area of the connection joint between the insert sleeves. At the same time, as a result of the groove cross-section configured in such a manner, a radially circumferential filling or receiving space is formed in which plugging mass or plugging mass particles can collect during operation of the clay gun machine cannon in order to fill this filling space and thus form a continuous transition between the insert sleeves with the lowest possible wear when the piston sweeps the connection joint in an axial movement.

If the insert sleeves have different outside diameters with the same inside diameters and are inserted in a stepped receiving bore of the cylinder liner to form a continuously axially extending wear sleeve assembly, the insert sleeves can be inserted in the bore of the cylinder liner from the same side without needing to overcome a corresponding insertion resistance over the entire bore depth as a result of a mechanical peripheral contact between the insert sleeves and the bore of the cylinder liner.

It is also particularly advantageous if a clearance fit is formed between the insert sleeves and the receiving bore of the cylinder liner, so that the insert sleeves can be inserted or exchanged in the cylinder liner with relatively low forces. It is hereby made easier to modify merely the radial relative arrangement of an insert sleeve in the bore of the cylinder liner as required in order, for example, to arrange the lowest longitudinal section of the insert sleeve, which is subjected to particular wear due to gravity, outside this wear zone and instead dispose a hitherto relatively unloaded longitudinal section of the insert sleeves in this wear zone and therefore overall increase the lifetime of the insert sleeve. A preferred embodiment is explained in detail hereinafter with reference to the drawings:

FIG. 1 shows a schematic view of a clay gun machine cannon with a pressure cylinder;

FIG. 2 shows a longitudinal sectional view of the pressure cylinder;

FIG. 3 shows a cross-sectional view of the pressure cylinder according to the profile of the line of intersection in FIG. 2;

FIG. 4 shows an enlarged detailed view of a connection joint area identified by IV in FIG. 2.

FIG. 1 shows as main components of a clay gun machine cannon 10, a pressure cylinder 11 with a filling opening 12 for the plugging mass 13 and a compaction ram 14 with a hydraulic drive 15 which can be moved to and fro in the pressure cylinder 11. The compaction ram 14 is sealed against an inner lateral surface 17 of the pressure cylinder 11 by a radially displaceable piston ring 16 which is formed by a wear sleeve assembly 18 inserted in the pressure cylinder 11.

The plugging mass 13 is pressed into the tapping hole of the furnace through a mouthpiece 19 attached at the front end of the pressure cylinder 11 as the compaction ram 14 advances.

FIG. 2 shows the pressure cylinder 11 with the wear sleeve arrangement 18 inserted in the receiving bore 20 of the pressure cylinder 11 in a longitudinal sectional view. In the present case the pressure cylinder 11 is designed as a welded structure comprising a cylinder liner 21 and flange rings 23, 24 connected at the front-side ends of the cylinder liner 21 by means of welded connections 22, which flange rings enable the pressure cylinder 11 to be connected to adjoining components of the clay gun machine cannon 10.

In the case of the present exemplary embodiment, the wear sleeve arrangement 18 is composed of two insert sleeves 25 and 26 which are inserted in the receiving bore 20 designed as a stepped bore. In this case, the insert sleeve 26 is located in a bore part 28 adjoining a stop end 27 of the cylinder liner 21, having a diameter $d_{B1}$ which has a smaller diameter compared to an adjacent bore part 30 extending to the insertion end 29, having a diameter $d_{B2}$.

As is deduced in particular from a combined view of FIGS. 2 and 4, the insert sleeves 25 and 26 have different outside diameters $D_{H1}$ and $D_{H2}$ with identical inside diameters $d_H$. The different outside diameters $D_{H1}$ and $D_{H2}$ of the insert sleeves 26 and 25 are matched to the bore diameters $d_{B1}$ and $d_{B2}$ of the bore parts 28 and 30 so that a clearance fit is obtained in each case between the insert sleeve 26 and the bore part 28 and the insert sleeve 25 and the bore part 30. When inserting the insert sleeves 25 and 26 from the insertion end 29 of the cylinder liner 21, a circumferential surface contact is only obtained between the insert sleeve 26 and the receiving bore 20 in the area of the rear bore part 28 relative to the insertion end 29.

FIG. 3 shows the front insert sleeve 25 in relation to the insertion end 29 received in the front bore part 30 of the cylinder liner 21. As can be seen from FIG. 3, the insert sleeve 25, like the insert sleeve 26 also shown in FIG. 2, consists of a plate section 31 specifically designed as a semi-finished product which is formed by a forming technique known per se from a planar extension into the pipe shape shown in FIG. 3. In order to form the insert sleeve 25 shown in FIG. 3, oppositely directed longitudinal edges 32, 33 of the plate section 31 as a result of the forming process are connected to one another by means of a welded connection 34.

Unlike the diagram of the cylinder liner 21 in FIG. 3, the cylinder liner 21 can also be formed from a tube manufactured in a forming process with subsequent welding. Unlike the insert sleeves 25, 26 which preferably consist of a low-alloyed sheet material hardened by heat treatment, the cylinder liner 21 can be made from a structural steel which is characterised by good weldability.

As shown in FIG. 3, the radial relative arrangement of the welded connection 34 of the insert sleeve 25 can advantageously be selected so that it is located outside, i.e. in the present case, diametrically opposite, a wear zone 35 formed in the radially lowest circumferential area of the cylinder liner 21. In the area of the wear zone 35, plugging mass particles 37 accumulate due to gravity which can be disposed between a piston lateral surface 36 and the lateral surface 17 or the insert sleeves 25, 26 during a lifting movement of the compaction ram 14 (see FIG. 1).

Unlike an effect which increases the wear, an accumulation of plugging mass particles 37, as shown in FIG. 4, in a groove cross-section 38 of an impact groove 40 formed in the area of a connection joint 39, which is formed by bevels 43, 44 formed on opposite front faces 41, 42, can ensure the formation of a continuous and therefore shoulder-less transition between the insert sleeves 25 and 26 so that in the area of the connection joint 39 the plugging mass particles 37 can ensure a reduction in friction in such an advantageous design.

The invention claimed is:

1. A clay gun machine cannon for metallurgical furnaces, said clay gun machine cannon comprising:
- a pressure cylinder having a filling opening for receiving a plugging mass, said pressure cylinder having a cylinder liner;
- a wear sleeve assembly inserted in the cylinder liner, said wear sleeve assembly being at least one insert sleeve made of a welded plate section, said welded plate section having a throughhole forming a filling opening aligned with said filling opening of said pressure cylinder; and
- a compaction ram for urging the plugging mass out of the pressure cylinder and into a tapping hole of the furnace.

2. The clay gun machine cannon according to claim 1, in which the plate section is formed into a tube with a longitudinal weld seam.

3. The clay gun machine cannon according to claim 1, in which the plate section is formed from a low-carbon steel hardened by heat treatment.

4. The clay gun machine cannon according to claim 3, in which the steel of the plate section includes less than 0.5 wt. % of C and less than 1.5 wt. % of Cr.

5. The clay gun machine cannon according to claim 4, in which the steel of the plate section includes less than 0.25 wt. % of C and less than 0.75 wt. % of Cr.

6. The clay gun machine cannon according to claim 1, in which the at least one insert sleeve has a wall thickness which is at least 10% of a wall thickness of the cylinder liner.

7. The clay gun machine cannon according to claim 6, in which the wall thickness of the insert sleeve is between 20% and 40% of the wall thickness of the cylinder liner.

8. The clay gun machine cannon according to claim 1, in which the wear sleeve assembly includes two insert sleeves.

9. A clay gun machine cannon for metallurgical furnaces, said clay gun machine cannon comprising:
- a pressure cylinder for receiving a plugging mass, said pressure cylinder having a cylinder liner;
- a wear sleeve assembly inserted in the cylinder liner, said wear sleeve assembly including two insert sleeves made of a welded plate section, in which the insert sleeves are inserted in the cylinder liner to form the wear sleeve assembly in such a manner that the insert sleeves form a connection joint with mutually opposite front faces, said front faces having a groove cross-section formed by bevels on inner edges of the front faces; and
- a compaction ram for urging the plugging mass out of the pressure cylinder and into a tapping hole of the furnace.

10. A clay gun machine cannon for metallurgical furnaces, said clay gun machine cannon comprising:
- a pressure cylinder for receiving a plugging mass, said pressure cylinder having a cylinder liner;
- a wear sleeve assembly inserted in the cylinder liner, said wear sleeve assembly including two insert sleeves made of a welded plate section, in which the insert sleeves have different outside diameters with the same inside diameters and are inserted in a stepped receiving bore of the cylinder liner to form a continuously axially extending wear sleeve assembly; and
- a compaction ram for urging the plugging mass out of the pressure cylinder and into a tapping hole of the furnace.

11. The clay gun machine cannon according to claim 1, in which a clearance fit is formed between the at least one insert sleeve and a receiving bore of the cylinder liner.

* * * * *